US011486218B1

(12) United States Patent
Ejim

(10) Patent No.: US 11,486,218 B1
(45) Date of Patent: Nov. 1, 2022

(54) SPLIT RISER LUBRICATOR TO REDUCE LIFTING HEIGHTS DURING TOOL INSTALLATION AND RETRIEVAL

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/501,118

(22) Filed: Oct. 14, 2021

(51) Int. Cl.

| | |
|---|---|
| ***E21B 33/035*** | (2006.01) |
| ***E21B 33/038*** | (2006.01) |
| ***E21B 17/01*** | (2006.01) |
| *E21B 33/06* | (2006.01) |

(52) U.S. Cl.
CPC ..... *E21B 33/038* (2013.01); *E21B 17/01* (2013.01); *E21B 33/0353* (2020.05); *E21B 33/06* (2013.01)

(58) Field of Classification Search
CPC .. E21B 33/035; E21B 33/0353; E21B 33/038; E21B 33/068; E21B 33/072; E21B 33/076
See application file for complete search history.

(56) References Cited

U.S. PATENT DOCUMENTS

| | | | | |
|---|---|---|---|---|
| 5,211,227 | A * | 5/1993 | Anderson | E21B 33/08 166/84.1 |
| 7,735,561 | B2 * | 6/2010 | Johnson | E21B 33/038 166/356 |
| 7,793,730 | B2 * | 9/2010 | Edwards | E21B 33/068 166/85.1 |
| 8,047,295 | B2 * | 11/2011 | Skeels | E21B 33/076 166/348 |
| 9,080,412 | B2 * | 7/2015 | Wetzel | E21B 19/161 |
| 9,145,761 | B2 * | 9/2015 | Hallundbæk | E21B 33/076 |
| 2010/0314128 | A1 * | 12/2010 | Cline | E21B 33/02 166/75.11 |

FOREIGN PATENT DOCUMENTS

| | | | | |
|---|---|---|---|---|
| EP | 3219905 | A1 * | 9/2017 | |
| WO | WO-2005020399 | A1 * | 3/2005 | H02G 1/08 |
| WO | 2011/153011 | A2 | 12/2011 | |

OTHER PUBLICATIONS

Nutter, Greg, et al., "Live Well Deployment of Retrievable ESP Systems, Case Histories", Society of Petroleum Engineers, SPE-185160-MS, pp. 1-8, 2017 (8 pages).

* cited by examiner

*Primary Examiner* — Matthew R Buck
(74) *Attorney, Agent, or Firm* — Osha Bergman Watanabe & Burton LLP

(57) ABSTRACT

A system includes a first split riser, a second split riser, and a gasket. The first split riser includes a first half pipe having a first radial extension and a second radial extension. The first radial extension and the second radial extension have a mating surface. The second split riser includes a second half pipe having a third radial extension and a fourth radial extension. The third radial extension and the fourth radial extension have a corresponding mating surface. The gasket is installed on the mating surface of the first radial extension and the second radial extension. The gasket mates with the corresponding mating surface to form a connection between the first split riser and the second split riser.

19 Claims, 4 Drawing Sheets

--Prior Art--

--Prior Art--

--Prior Art--

SPLIT RISER LUBRICATOR TO REDUCE LIFTING HEIGHTS DURING TOOL INSTALLATION AND RETRIEVAL

BACKGROUND

In the oil and gas industry, hydrocarbons are located in porous reservoirs far beneath the Earth's surface. Wells are drilled into these reservoirs to access and produce said hydrocarbons. When wells are put on production, the wells are highly pressurized as they are directly open to the reservoir. Wells are capped at the surface with production trees. Production trees are a series of spools and valves that are rated to the pressures seen by the wells. Production trees are used to contain formation fluids, such as hydrocarbons, and controllably produce the formation fluids.

After a well has been put on production, or while the well is in the process of being put on production (such as during completion operations), the well can be accessed through the production tree. The production tree allows access to the well through the series of valves; however, once a valve is open, the pressures seen within the well are now open to the environment. As such, a lubricator is used to provide pressure control while interacting with the well. A lubricator contains pressure control equipment, greasing equipment, and a riser. The riser is used to equalize pressure between the well and the tool being run into the well. Thus, the length of the riser must be at least the length of the tool being run into the well such that the entire length of the tool can be contained within the riser while undergoing pressure equalization.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in accordance with one or more embodiments, a system and a method for running a tool in a well. The system includes a first split riser, a second split riser, and a gasket. The first split riser includes a first half pipe having a first radial extension and a second radial extension. The first radial extension and the second radial extension have a mating surface. The second split riser includes a second half pipe having a third radial extension and a fourth radial extension. The third radial extension and the fourth radial extension have a corresponding mating surface. The gasket is installed on the mating surface of the first radial extension and the second radial extension. The gasket mates with the corresponding mating surface to form a connection between the first split riser and the second split riser.

The method includes providing a first split riser having a first half pipe with a first radial extension and a second radial extension. The first radial extension and the second radial extension have a mating surface, and the first radial extension and the second radial extension have a gasket installed on the mating surface. The method also includes providing a second split riser having a second half pipe with a third radial extension and a fourth radial extension. The third radial extension and the fourth radial extension have a corresponding mating surface. The method further includes laterally inserting the tool into the first split riser, forming a connection between the first split riser and the second split riser by mating the gasket to the corresponding mating surface, and running the tool into the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1C:
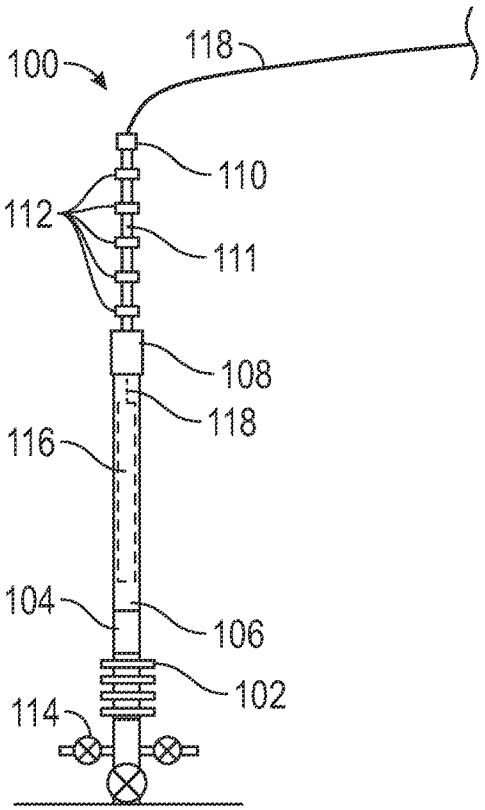
FIGS. 1*a*-1*c* show a conventional lubricator system in accordance with one or more embodiments.
Figure 1B:
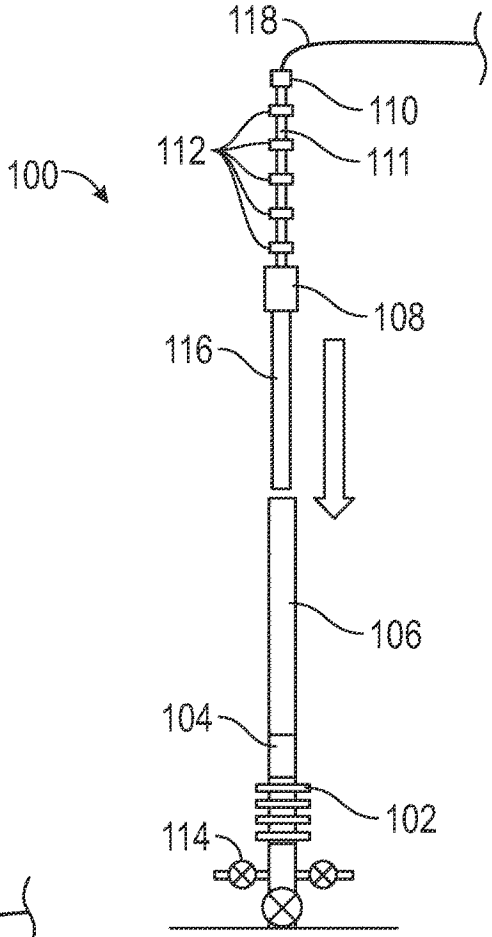
Figure 1A:
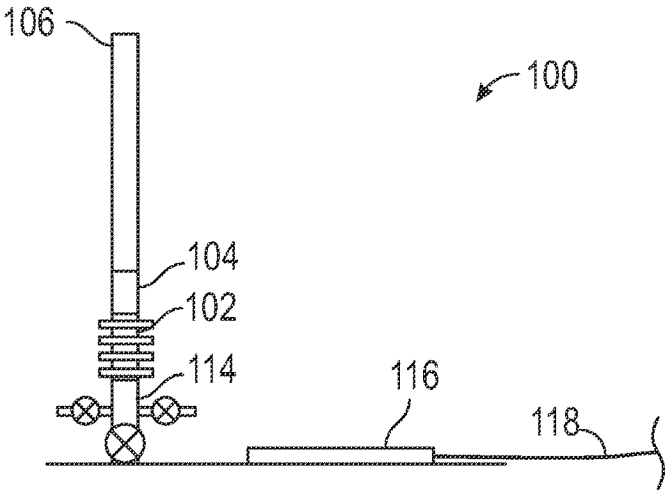

FIGS. 1*a*-1*c* show a conventional lubricator (100) system in accordance with one or more embodiments. The lubricator (100) system includes a lubricator (100) blow out preventer (BOP) (102), a tool trap (104), a riser (106), a tool catcher (108), a stuffing box (110)), and grease injector ports (112). The lubricator (100) system is placed on top of a production tree (114) that caps an underground well. A tool (116) is run on a cable (118) through the lubricator (100) system and into the well. The cable (118) may be wireline or slickline connected to a wireline or slickline unit (not pictured).

Herein, the terms "top" and "bottom" are in reference to the Earth's surface. The bottom refers to the portion of the component closer to the surface of the Earth and the top refers to the portion of the component opposite the bottom and further away from the surface of the Earth when compared to the bottom. The tool (116) being used in conjunction with the disclosed lubricator (100) system may be any tool (116) that may be run into a well such as an electric submersible pump assembly, a bottom hole assembly, a fishing assembly, etc.

The lubricator (100) BOP (102) is similar to a BOP used in drilling operations, but a lubricator (100) BOP (102) is designed to mitigate a well control situation during an operation employing a cable (118) and a tool (116) rather than an operation employing a drill string. The lubricator (100) BOP (102) may be any type of lubricator (100) BOP (102) known in the art. The tool trap (104) prevents the loss of the tool (116) in the well due to the cable's (118) rope socket being stripped out. The tool trap (104) may be any type of tool trap (104) known in the art. The riser (106) is used to hold the tool (116), and provide a pressure tight seal, while pressure is being equalized between the well and the tool (116). The riser (106) may be made out of steel pipe.

The tool catcher (108) is designed to catch the tool (116) if the tool (116) is pulled too quickly through the lubricator (100) system. The tool catcher (108) may be any tool catcher (108) known in the art. The grease injector ports (112) are connected to grease lines (not pictured) that provide grease to the grease injector ports (112). Because the cable (118), running through the stuffing box (110)) into the lubricator (100) system, provides a small annulus for pressure to escape the lubricator (100) system, the grease from the grease injector ports (112) helps contain the pressure within the lubricator (100) by filling the cable (118) annulus with grease. This allows the cable (118) to move the tool (116) up and down within the well without releasing pressure to the environment. The stuffing box (110) is an assembly that houses a gland seal and is used to prevent leakage of fluid from the lubricator (100). The stuffing box (110) may be any type of stuffing box (110) known in the art.

Pressure must be equalized between the tool (116) and the well because the well is under a much higher pressure than the tool (116) which is at atmospheric pressure. Once the lubricator (100) system is completely assembled on top of the production tree (114), the lubricator (100) system is at atmospheric pressure yet also isolated from the atmosphere. One or more valves in the production tree (114), such as a crown valve, an upper master valve, and a lower master valve, are slowly opened and the tool (116) in the riser (106) equalizes to the pressure seen by the well.

Upon pressure equalization, the tool (116) is able to be run into the well. When it is time to remove the tool (116) from the well, the tool (116) is pulled into the riser (106), using the cable (118), and the valves in the production tree (114) are closed. Pressure is then bled from the riser (106) until the pressure within the riser (106) and the pressure seen by the tool (116) is equal to atmospheric pressure. At this point, the tool (116) may be safely removed from the lubricator (100) system. If pressure is not properly equalized throughout the riser (106) and across the tool (116), the tool (116) could shoot out the top of the well and be a safety hazard.

As shown in FIG. 1*c*, the BOP (102) is installed on top of the production tree (114), the riser (106) is installed on top of the BOP (102), the tool catcher (108) is installed on top of the riser (106), the grease injection ports (112) are installed along a pipe (111) connected to the top of the riser (106), and the stuffing box (110) is connected to the top of the pipe (111) having the grease injector ports (112). To assemble the lubricator (100) system that is shown in FIG. 1*c*, initially, the BOP (102), the tool trap (104), and the riser (106) are installed to the production tree (114) as shown in FIG. 1*a*.

As shown in FIG. 1*b*, the tool catcher (108), the grease injector ports (112), and the stuffing box (110) are installed together, separate from the production tree (114). A cable (118) is run through the stuffing box (110), grease injector ports (112), and tool catcher (108). A tool (116) is then connected to the cable (118). Commonly, this portion of the operation is performed on a work surface such as the ground or work platform. As shown in FIG. 1*b*, the tool (116)/tool catcher (108)/grease injector ports (112)/stuffing box (110) apparatus is lifted, using a lifting device such as a crane (not pictured), above the riser (106)/tool trap (104)/BOP (102) apparatus already installed on the production tree (114).

As the tool (116)/tool catcher (108)/grease injector ports (112)/stuffing box (110) apparatus is being lifted off of the ground, or work platform, and into the air, slack is slowly let off on the cable (118) connected to the tool (116) such that the tool (116) can rise into the air with the other equipment without snapping the cable (118). As shown in FIG. 1*c*, the crane lowers the tool (116) into the riser (106) until the tool (116) is completely within the riser (106) and the tool catcher (108) is on top of the riser (106). The tool catcher (108) is connected to the riser (106) to form the completed lubricator (100) system. All connections formed in this entire operation may be formed by any means known in the art such as bolted flange connections.

As can be seen in FIG. 1*b*, the crane being used to put together the lubricator (100) system must be able to reach a maximum height that includes the heights of both the riser (106) and the tool (116). Oftentimes, operations are limited to the crane available, meaning that the combined height of the riser (106) and tool (116) must equal the maximum height of the available crane. This limits the length of the tool (116) that can be used in the well. As wells are narrow holes in the ground, the majority of the size of a tool (116) comes from the length rather than the width.

Therefore, methods and systems that allow for longer tools (116) to be run into a well are beneficial. As such embodiments disclosed herein present a split riser system, and method for use of the split riser system, that allows a tool (116) to be laterally placed within the riser (106) through the side of the riser (106) rather than be lowered into the riser (106) through the top of the riser (106). This means that the crane used to lift the tool (116) only needs to be able to lift the tool (116) to a maximum height that is half of the height required by conventional methods and systems.

Figure 2B:
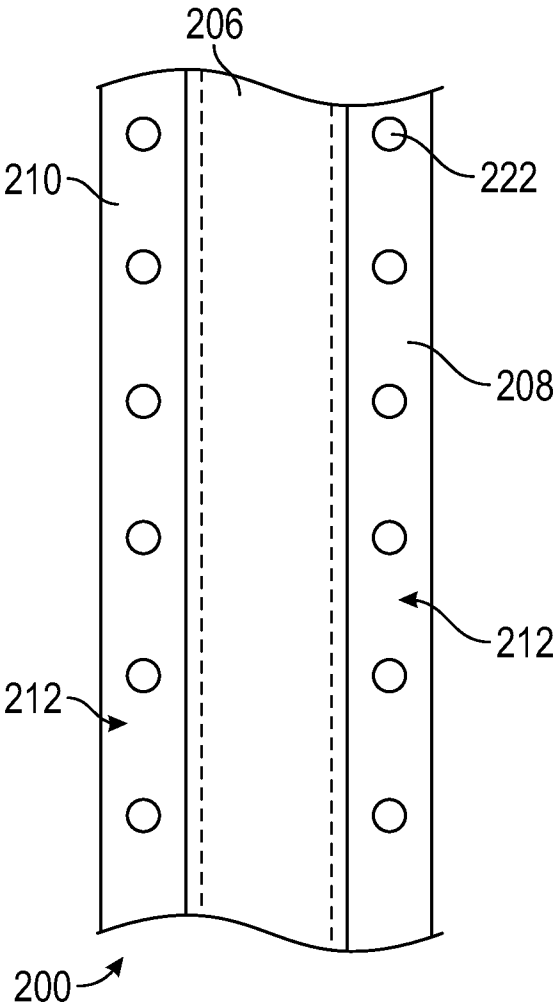
FIGS. 2*a* and 2*b* show a split riser system in accordance with one or more embodiments.
Figure 2A:
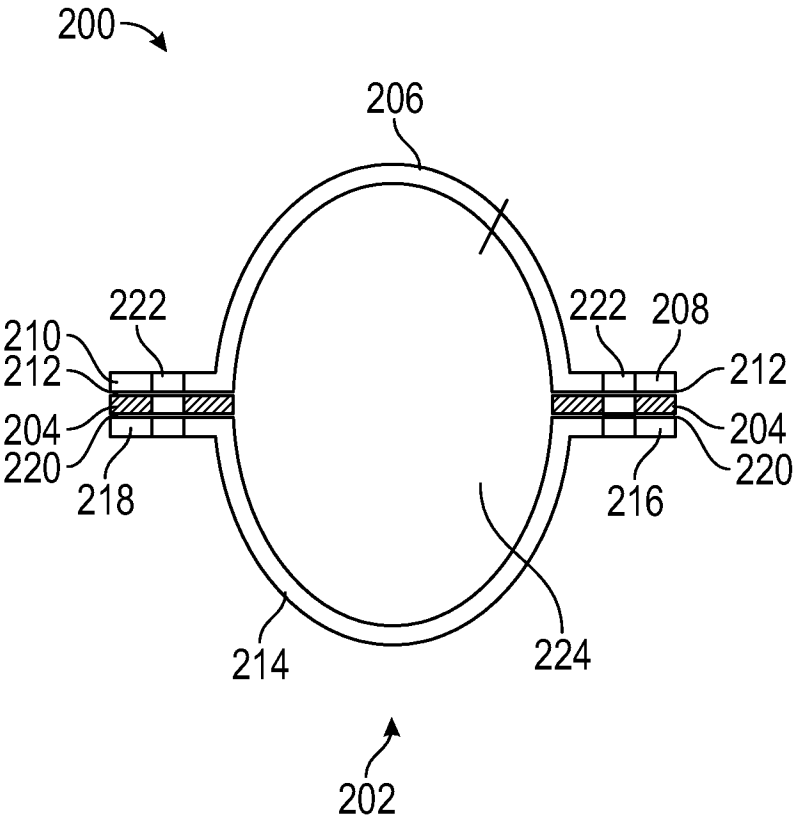

FIGS. 2*a* and 2*b* show a split riser system in accordance with one or more embodiments. Specifically, FIG. 2*a* shows a cross sectional view of the entire split riser system. The split riser system includes a first split riser (200), a second split riser (202), and a gasket (204). A cross section of the first split riser (200) is shown in FIG. 2*b*. The first split riser (200) is comprised of a first half pipe (206) that has a first radial extension (208) and a second radial extension (210). The first radial extension (208) and the second radial extension (210) have a mating surface (212). In one or more embodiments, the first half pipe (206), the first radial extension (208), and the second radial extension (210) may be machined as one component.

In other embodiments, the first radial extension (208) and the second radial extension (210) are welded to the sides of the first half pipe (206). The first half pipe (206) is a horizontal cylindric segment. A horizontal cylindrical segment is a solid cut from a horizontal cylinder by a single plane oriented parallel to the cylinder's axis of symmetry.

The first radial extension (208) and the second radial extension (210) are flat rectangular pieces of material. The first half pipe (206), the first radial extension (208), and the second radial extension (210) may be made out of the same material such as steel and may have the same wall thickness.

The second split riser (202) is a mirror image of the first split riser (200) and has the same dimensions as the first split riser (200) such that the first split riser (200) and the second split riser (202) may line up with one another. The second split riser (202) is comprised of a second half pipe (214) that has a third radial extension (216) and a fourth radial extension (218). The third radial extension (216) and the fourth radial extension (218) have a corresponding mating surface (220). In one or more embodiments, the second half pipe (214), the third radial extension (216), and the fourth radial extension (218) may be machined as one component.

In other embodiments, the third radial extension (216) and the fourth radial extension (218) are welded to the sides of the second half pipe (214). The second half pipe (214) is a horizontal cylindric segment. The third radial extension (216) and the fourth radial extension (218) are flat pieces. The second half pipe (214), the third radial extension (216), and the fourth radial extension (218) may be made out of the same material such as steel and may have the same wall thickness.

The gasket (204) is a piece of rubber that is installed along the mating surface (212) of the first radial extension (208) and the second radial extension (210). The gasket may also be installed along the corresponding mating surface (220) of the third radial extension (216) and the fourth radial extension (218) without departing from the scope of the disclosure herein. The gasket (204) may be installed partially or completely along the mating surface (212). The gasket (204) may be installed in the mating surface (212) by being chemically bonded to the mating surface (212).

The gasket (204), once installed on the mating surface (212), mates with the corresponding mating surface (220) to form a connection between the first split riser (200) and the second split riser (202). A plurality of bolt holes (222) are machined into the first radial extension (208), the second radial extension (210), the third radial extension (216), the fourth radial extension (218), and the gasket (204). The bolt holes (222) are machined into each of the previously named components such that the bolt holes (222) line up with one another when the gasket (204) is installed on the first split riser (200) and when the first split riser (200) and the second split riser (202) are placed together to form the connection.

Further, the connection is formed by lining up the plurality of bolt holes (222), inserting a bolt (not pictured), and securing the bolt into each lined-up bolt hole (222). The bolt may be any bolt known in the art and the bolt may be used in conjunction with a nut to aid in securing the bolt within the bolt holes (222). Due to the gasket (204) and the secured bolt in the bolt holes (222), the connection between the first split riser (200) and the second split riser (202) forms a pressure-tight cavity (224). The pressure-tight cavity is configured to hold a tool (116). The first split riser (200) and the second split riser (202) have minimum length equal to the length of the planned tool (116).

Figure 3C:
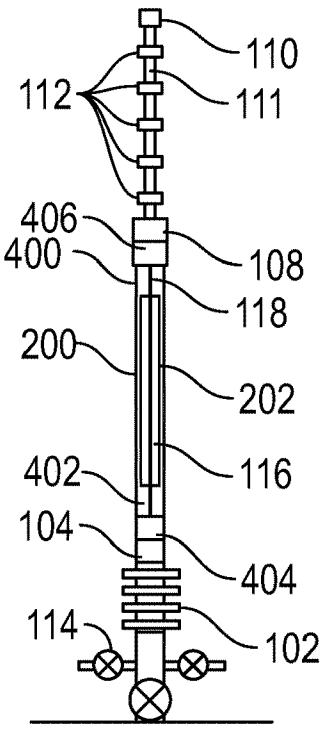
FIGS. 3*a*-3*c* show the split riser system being used in conjunction with a lubricator system in accordance with one or more embodiments.
Figure 3B:
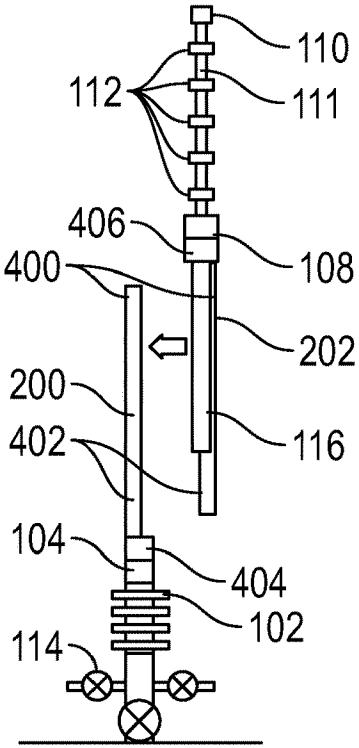
Figure 3A:
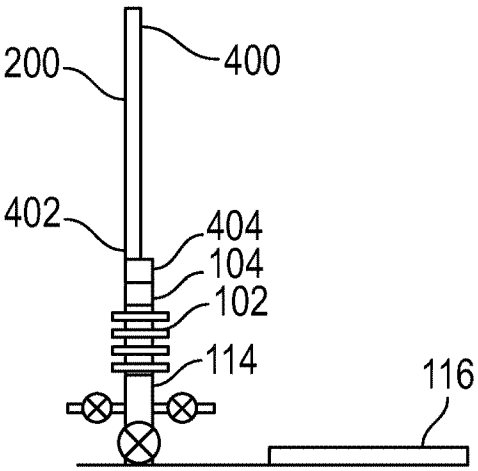

FIGS. 3*a*-3*c* show the split riser system, as depicted in FIGS. 2*a* and 2*b*, used in place of the riser (106) in the lubricator (100) system, as depicted in FIGS. 1*a*-1*c*. Components of FIGS. 3*a*-3*c* that are the same as or similar to components described in FIGS. 1*a*-2*b* have not been redescribed for purposed of readability and have the same function and description as outlined above. Specifically, FIG. 3*c* shows the entire lubricator (100) system installed on top of a production tree (114) using the split riser system. FIGS. 3*a* and 3*b* show steps involved for assembling the lubricator (100) using the split riser system.

The first split riser (200) and the second split riser (202) each have a top end (400) and a bottom end (402). As shown in FIG. 3*a*, the BOP (102) is installed on top of the production tree (114) and the tool trap (104) is installed on top of the BOP (102). The bottom end (402) of the first split riser (200) is installed to the top of the tool trap (104) using a first adapter (404). The first adapter (404) is used because commercially available tool traps (104) are designed to be connected to a conventional riser (106), as described in FIGS. 1*a*-1*c*, not a first split riser (200), as described in FIGS. 2*a* and 2*b*. The bottom end (402) of the first split riser (200) may be connected to the first adapter (404) and the first adapter (404) may be connected to the top of the tool trap (104) by any means known in the art, such as a bolted connection.

A greasing system is installed to the top end (400) of the second split riser (202). The greasing system includes the tool catcher (108), the grease injector ports (112), and the stuffing box (110). The stuffing box (110) is connected to the top of the pipe (111) having the plurality of grease injector ports (112) and the pipe (111) is connected to the top of the tool catcher (108). The top end (400) of the second split riser (202) is connected to the bottom of the tool catcher (108) using a second adapter (406). The second adapter (406) is used because commercially available tool catchers (108) are designed to be connected to a conventional riser (106), as described in FIGS. 1*a*-1*c*, not a second split riser (202), as described in FIG. 2*a*. The second split riser (202) may be connected to the second adapter (406) and the second adapter (406) may be connected to the tool catcher (108) by any means known in the art, such as a bolted connection.

A cable (118) is run through the stuffing box (110)/tool catcher (108)/second split riser (202) apparatus. A tool (116) is then connected to the cable (118). The tool (116)/tool catcher (108)/grease injector ports (112)/stuffing box (110)/second split riser (202) apparatus is assembled on a work surface or a work platform separate than the production tree (114). The tool (116)/tool catcher (108)/grease injector ports (112)/stuffing box (110)/second split riser (202) apparatus is lifted by a lifting device, such as a crane. The crane moves the tool (116) and the second split riser (202) laterally into the first split riser (200) as shown in FIG. 3*b*. With the tool (116) located in the cavity (224) between the first split riser (200) and the second split riser (202), the connection is formed between the first split riser (200) and the second split riser (202) by lining up the bolt holes (222), inserting bolts into the bolt holes (222), and securing the bolts into the bolt holes (222) to form the split riser lubricator (100) system shown in FIG. 3*c*.

Figure 4:
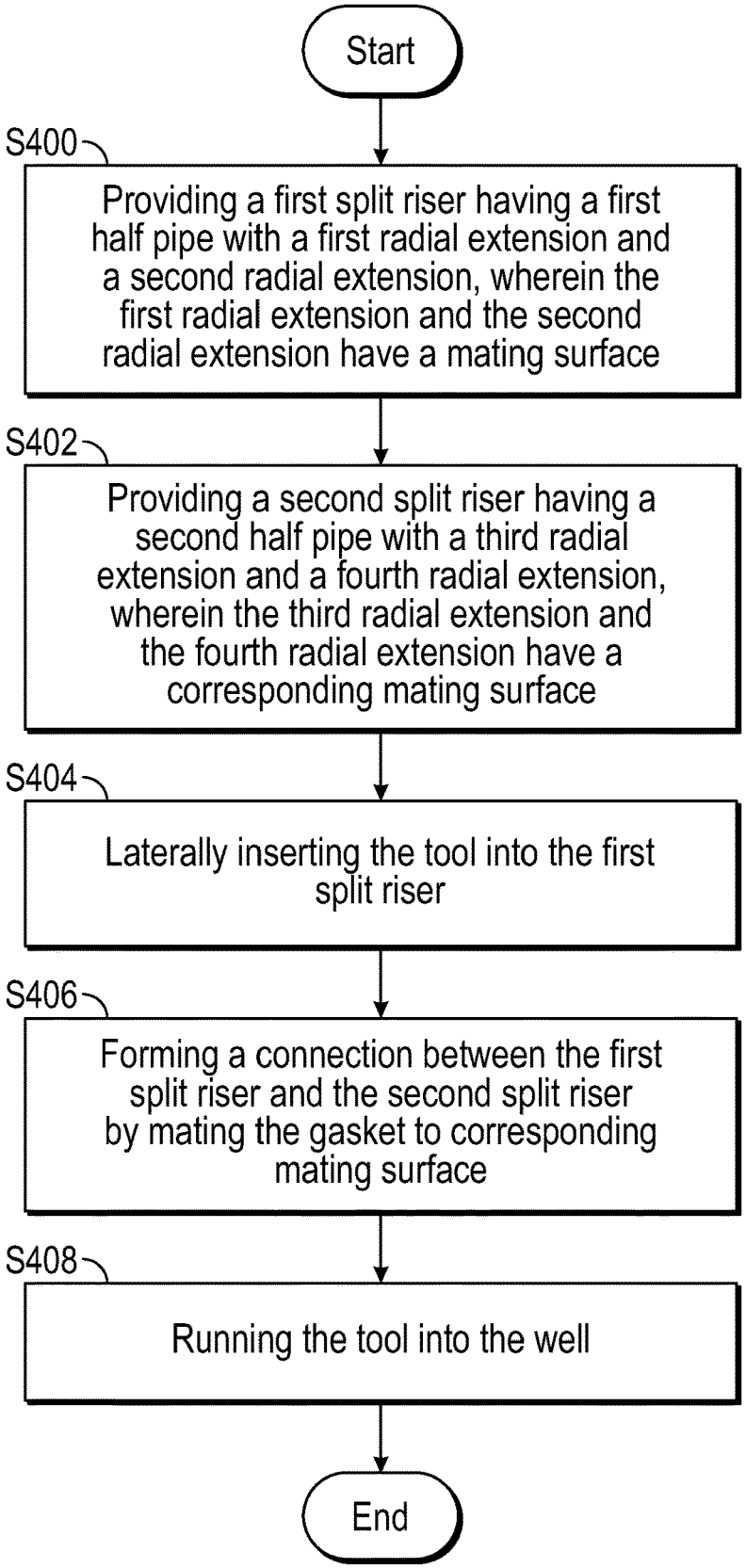
FIG. 4 shows a flowchart in accordance with one or more embodiments.

FIG. 4 shows a flowchart in accordance with one or more embodiments. Specifically, the flowchart outlines a method for running a tool (116) into a well. Further, one or more blocks in FIG. 4 may be performed by one or more components as described in FIGS. 1-3*c*. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a first split riser (200) having a first half pipe (206) with a first radial extension (208) and a second radial extension (210) is provided. The first radial extension (208) and the second radial extension (210) have a mating surface (212) (S400). A BOP (102) may be installed on top of a production tree (114) connected to the well. A tool trap (104) may be installed on top of the BOP (102). A bottom end (402) of the first split riser (200) may be installed on top of the tool trap (104) using a first adapter (404).

A second split riser (202) having a second half pipe (214) with a third radial extension (216) and a fourth radial extension (218) is provided. The third radial extension (216) and the fourth radial extension (218) have a corresponding mating surface (220) (S402). A greasing system may be installed to a top end (400) of the second split riser (202) using a second adapter (406). The greasing system may include a stuffing box (110), a pipe (111) having grease injector ports (112), and a tool catcher (108). The bottom of the tool catcher (108) may be connected to the top end (400) of the second split riser (202).

A gasket (204) is installed on the mating surface (212) of the first radial extension (208) and the second radial extension (210). The gasket (204) may be installed on the mating surface (212) by chemically bonding the gasket (204) to the mating surface (212). In one or more embodiments, the gasket (204) is installed to the mating surface (212) during the manufacturing process of the first split riser (200) and second split riser (202). In other embodiments, the gasket (204) is installed to the mating surface (212) in the field. Further, a plurality of bolt holes (222) may be machined into the first radial extension (208), the second radial extension (210), the third radial extension (216), the fourth radial extension (218), and the gasket (204).

The tool (116) is laterally inserted into the first split riser (200) (S404). The tool (116) may be inserted into the first split riser (200) by lifting the stuffing box (110)/grease injector ports (112)/tool catcher (108)/second split riser (202)/tool (116) using a lifting device, such as a crane. The tool (116) enters the concave portion of the first half pipe (206) followed by the concave portion of the second half pipe (214).

A connection is formed between the first split riser (200) and the second split riser (202) by mating the gasket (204) to the corresponding mating surface (220) (S406). The connection forms a pressure-tight cavity (224) for housing the tool (116). Further, the connection may be formed by lining up the plurality of bolt holes (222), inserting a bolt, and securing the bolt into each lined-up bolt hole (222). Pressure may be equalized between the well and the tool (116) using the connection formed between the first split riser (200) and the second split riser (202). Upon pressure equalization, the tool (116) is run into the well (S408).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system comprising:

a first split riser comprising a first half pipe having a first radial extension and a second radial extension, wherein the first radial extension and the second radial extension have a mating surface;

a second split riser comprising a second half pipe having a third radial extension and a fourth radial extension, wherein the third radial extension and the fourth radial extension have a corresponding mating surface;

a gasket installed on the mating surface of the first radial extension and the second radial extension, wherein the gasket, installed on the mating surface, mates with the corresponding mating surface to form a connection between the first split riser and the second split riser; and a blow out preventer installed on a production tree.

2. The system of claim 1, wherein the gasket is installed on the mating surface by being chemically bonded to the mating surface.

3. The system of claim 1, wherein the connection between the first split riser and the second split riser forms a pressure-tight cavity configured to hold a tool.

4. The system of claim 3, further comprising:

a plurality of bolt holes machined into the first radial extension, the second radial extension, the third radial extension, the fourth radial extension, and the gasket.

5. The system of claim 4, wherein the connection is formed by lining up the plurality of bolt holes, inserting a bolt, and securing the bolt into each lined-up bolt hole.

6. The system of claim 1, further comprising:

a tool trap installed on the blow out preventer.

7. The system of claim 6, wherein the first split riser and the second split riser have a bottom end and a top end, and the bottom end of the first split riser is installed on the tool trap, using a first adapter.

8. The system of claim 7, further comprising:

a greasing system having a tool catcher, a plurality of grease injector ports, and a stuffing box.

9. The system of claim 8, wherein the greasing system is installed to the top end of the second split riser, using a second adapter.

10. A method for running a tool into a well, the method comprising:

providing a first split riser having a first half pipe with a first radial extension and a second radial extension, wherein the first radial extension and the second radial extension have a mating surface and the first radial extension and the second radial extension have a gasket installed on the mating surface;

providing a second split riser having a second half pipe with a third radial extension and a fourth radial extension, wherein the third radial extension and the fourth radial extension have a corresponding mating surface;

laterally inserting the tool into the first split riser;

forming a connection between the first split riser and the second split riser by mating the gasket to the corresponding mating surface; and running the tool into the well.

11. The method of claim 10, wherein installing the gasket to the mating surface of the first radial extension and the second radial extension further comprises chemically bonding the gasket to the mating surface.

12. The method of claim 10, wherein forming the connection between the first split riser and the second split riser by mating the gasket to the corresponding mating surface further comprises forming a pressure-tight cavity for housing the tool.

13. The method of claim 12, wherein forming the connection between the first split riser and the second split riser by mating the gasket to the corresponding mating surface further comprises machining a plurality of bolt holes into the first radial extension, the second radial extension, the third radial extension, the fourth radial extension, and the gasket.

14. The method of claim 13, wherein forming the connection between the first split riser and the second split riser by mating the gasket to the corresponding mating surface further comprises lining up the plurality of bolt holes, inserting a bolt, and securing the bolt into each lined-up bolt hole.

15. The method of claim 10, further comprising:

installing a blow out preventer on a production tree connected to the well.

16. The method of claim 15, further comprising:

installing a tool trap on the blow out preventer.

17. The method of claim 16, further comprising:

installing a bottom end of the first split riser to the tool trap using a first adapter.

18. The method of claim 17, further comprising:

installing a greasing system to a top end of the second split riser, using a second adapter.

19. The method of claim 18, wherein running the tool into the well further comprises equalizing pressure between the well and the tool using the connection formed between the first split riser and the second split riser.

* * * * *